United States Patent [19]

Kato

[11] 4,102,617

[45] Jul. 25, 1978

[54] OIL SEAL MEANS IN A ROTARY PISTON ENGINE

[75] Inventor: Kazuo Kato, Toyota, Japan

[73] Assignee: Toyota Jidosha Kogyo Kabushiki Kaisha, Toyota, Japan

[21] Appl. No.: 782,397

[22] Filed: Mar. 29, 1977

[30] Foreign Application Priority Data

Nov. 12, 1976 [JP] Japan ..... 51-136702

[51] Int. Cl.[2] ..... F01C 19/00; F04C 15/00; F04C 27/00

[52] U.S. Cl. ..... 418/142

[58] Field of Search ..... 418/142, 144, 117; 277/123, 81 P, 96.1, 96.2

[56] References Cited

U.S. PATENT DOCUMENTS

| | | | |
|---|---|---|---|
| 3,300,127 | 1/1967 | Yamamoto et al. | 418/142 X |
| 3,535,061 | 10/1970 | Yamamoto | 418/142 |
| 3,575,541 | 4/1971 | Hamada | 418/142 |
| 3,853,440 | 12/1974 | Green | 418/142 |
| 3,884,602 | 5/1975 | Phillips | 418/142 |
| 3,924,979 | 12/1975 | Rose | 418/142 |
| 3,941,523 | 3/1976 | Shin et al. | 418/142 X |
| 3,976,406 | 8/1976 | Sasaki | 418/142 |

*Primary Examiner*—Carlton R. Croyle
*Assistant Examiner*—Leonard Smith
*Attorney, Agent, or Firm*—Stevens, Davis, Miller & Mosher

[57] ABSTRACT

An oil seal means in a rotary piston engine including first and second assemblies of oil seal rings, annular spring means and annular elastic seal elements mounted in annular oil seal grooves, arranged concentric and close to each other with an annular land interposed therebetween, said annular land being a flexible annular land movable in any radially directions of the rotor.

5 Claims, 5 Drawing Figures

OIL SEAL MEANS IN A ROTARY PISTON ENGINE

BACKGROUND OF THE INVENTION

1. Field of the Invention

The present invention relates to an oil seal means in a rotary piston engine and, more particularly, an oil seal means provided in a slide wall portion of a rotor of the engine for maintianing the air/oil tightness in the contact of the rotor side wall with the side housing.

2. Description of the Prior Art

The Wankel type rotary piston engine has a general structure such as shown in FIG. 1 wherein it comprises a casing composed of a rotary housing 1 having a trochoidal inner peripheral surface and side housings 2 which close the opposite open ends of said rotor housing, and a polygonal rotor 4 mounted in said casing to eccentrically rotate around an eccentric shaft 3 with apex portions thereof sliding over said trochoidal inner peripheral surface of said rotor housing. The rotor comprises an annular oil seal means generally designated by reference numeral 6 in each side wall 5 thereof for maintaining the air/oil tightness in the contact of said side wall of the rotor with the inner wall surface of the side housing.

One of the most basic sectional structures of such an oil seal means is shown in FIG. 2 which corresponds to the section along line II—II in FIG. 1. As shown in FIG. 2, the oil seal means comprises first and second annular oil seal grooves 7,7' concentrically formed in the side wall 5 of the rotor, and first and second combinations of oil seal rings 8,8', annular spring means such as annular corrugated springs 9,9' and annular elastic seal elements such as O-rings 10,10', said first and second combinations being mounted in said first and second grooves, respectively. The assemblies of said first and second grooves and said first and second combinations provide respectively first and second oil means arranged to be concentric to each other with an annular land 11 interposed therebetween.

When the rotor 4 incorporating these oil seal means eccentrically rotates around the eccentric shaft 3, the oil seal rings 8,8' are exerted not only a force which rotationally drives said rings along said annular grooves in the direction opposite the rotational direction of the rotor but also a force which drives the rings in radial directions of the rotor due to the reaction of the engaging side housing. Therefore, at a certain phase of rotation of the rotor, a particular portion of the rotor moves radially downward as shown by the arrow in FIG. 3 relative to the side housing, whereby the oil seal rings 8,8' are driven and biased upward in the figure. In this condition the concerned portion of the oil seal ring 8 is directly supported by the outer side wall of the annular oil seal groove 7 by way of an oil while the concerned portion of the oil seal ring 8' is supported by an annular land 11 by way of the annular elastic seal element 10' which is, therefore, prone to be compressed excessively. This means, as a matter of course, that in a diametrically opposite sectional portion the oil seal ring 8 is supported by the annular land 11 by way of the annular elastic seal element 10, which is then prone to be compressed excessively. When such an excessive compression of the annular seal element is repeated, the element fatigues, deteriorates and loses the elasticity thereby damaging the sealing performance of the oil seal means, resulting in an increase of the oil comsumption of the engine.

SUMMARY OF THE INVENTION

It is therefore the object of the present invention to avoid the deterioration of the annular elastic seal element due to the aforementioned excessive compression repeatedly applied thereto, and to provide an improved oil seal means wherein the durability of the annular elastic seal element is particularly improved.

In accordance with the present invention, the above-mentioned object is accomplished by an oil seal means in a rotary piston engine comprising first and second annular oil seal grooves concentrically formed in the side wall of a rotor and first and second combinations of oil seal rings, annular spring means and annular elastic seal elements, said first and second combinations being mounted in said first and second grooves, respectively, wherein the improvement comprises a flexible annular land means provided between the first and second groves, said land means being movable in any radial directions of the rotor.

BRIEF DESCRIPTION OF THE DRAWING

In the accompanying drawing.

DESCRIPTION OF THE PREFERRED EMBODIMENT

Figure 1:
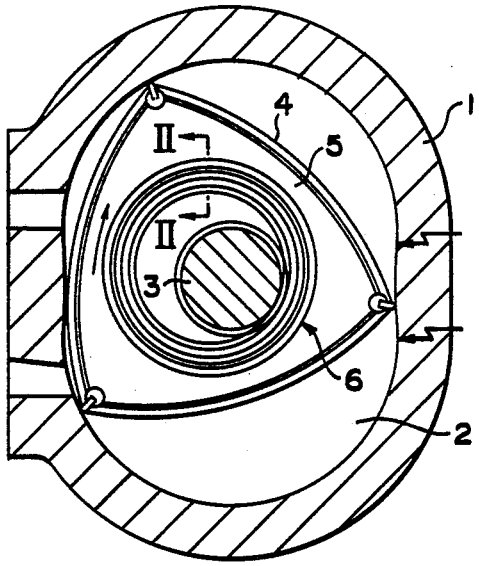
FIG. 1 PRIOR ART
FIG. 1 is a diagrammatical sectional view showing the general structure of the Wankel type rotary piston engine.
Figure 2:
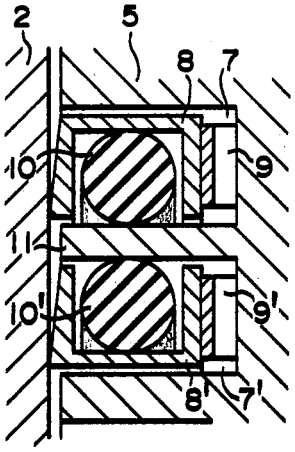
FIG. 2 PRIOR ART
FIG. 2 is a sectional view along line II—II in FIG. 1 showing one of the most basic structures of the oil seal means.
Figure 3:
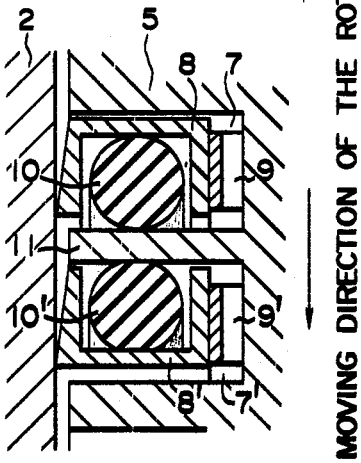
FIG. 3 PRIOR ART
FIG. 3 is a view similar to FIG. 2 showing a particular operating condition of the oil seal means shown in FIG. 2.
Figure 4:
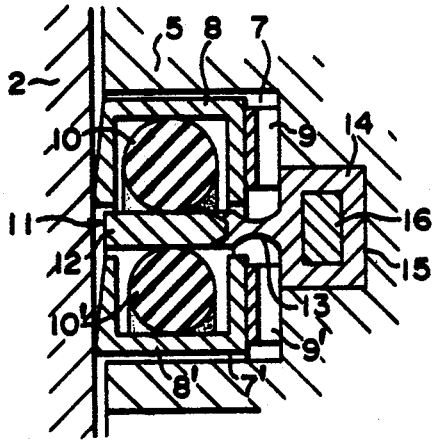
FIG. 4 is a view similar to FIG. 2 showing an embodiment of the oil seal means of the present invention; and, FIG. 5 is a view similar to FIG. 4 but also including a diametrically opposite portion of the oil seal means, showing an operating condition of the oil seal means shown in FIG. 4.
Figure 5:
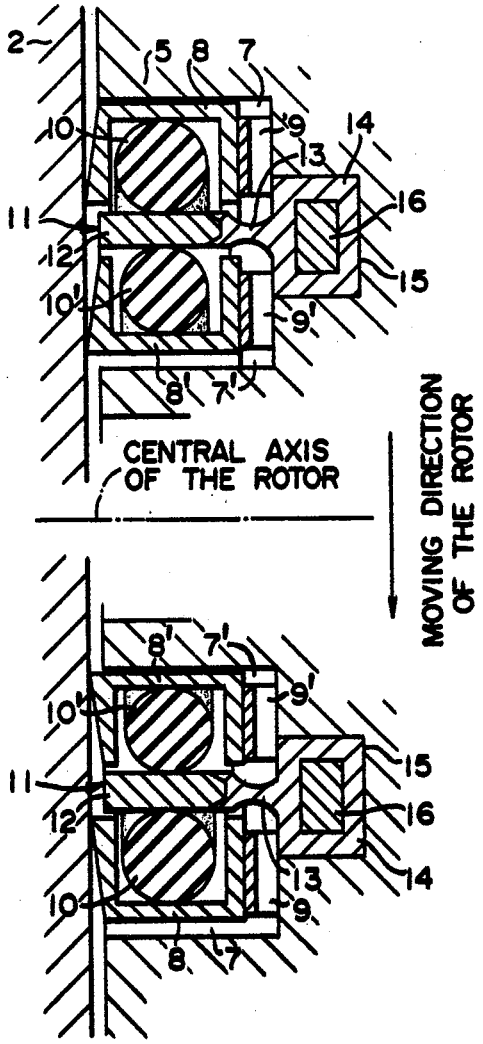

In the following the invention will be described with respect to a preferred embodiment with reference to FIGS. 4 and 5 showing an embodiment of the present invention in the same manner as in FIGS. 2 and 3. In FIGS. 4 and 5, the portions corresponding to those shown in FIGS. 2 and 3 are designated by the same reference. In the shown embodiment, the flexible annular land means 11 comprises a metal ring 12 and a bellows portion 13 made of a flexible material such as rubber or the like, such a bellows portion supporting said metal ring and forming a root portion of the flexible annular land means. In the shown particular embodiment, the bellows portion 13 includes an annular bead portion 14 arranged along an end thereof, said annular bead portion is mounted in an annular groove 15 formed in the side wall of the rotor. The annular bead portion 14 encloses therein a metal ring 16 serving as a core element of the annular bead portion.

FIG. 5 is a view showing the oil seal means shown in FIG. 4 in an operating condition, wherein the shown sectional portion of the rotor is moving radially downward in the figure relative to the side housing in the same manner as in FIG. 3. In FIG. 5 the two diametrically opposite sectional portions are shown in the same operating condition. In this condition, although the oil seal rings 8,8' are biased upward in the annular oil seal grooves 7,7', since the annular land means, particularly the metal ring portion 12 is also biased upward due to its flexibility, it is avoided that the annular elastic seal elements 10,10' are excessively compressed and, as shown in FIG. 5, the annular elastic seal elements are maintained in a normallly compressed condition as in the standard condition shown in FIG. 4.

Thus, in accordance with the present invention, the annular elastic seal elements 10,10' are constantly maintained in a properly compressed condition between the oil seal rings and the flexible annular land means throughout the entire rotary phase of the rotor so as to avoid that they are subject to repeated applications of an excessive compression.

Furthermore, since the flexible annular land means, particularly the metal ring portion 12 is manufactured separately from the body of the rotor, the annular peripheral surfaces of the metal ring which contact the annular elastic seal elements can easily be polished in any desired fine condition so that the wearing of the annular elastic seal element is reduced thereby ensuring a long life of the seal element.

Although the invention has been shown and described with respect to a preferred embodiment thereof, it should be understood by those skilled in the art that various changes and omissions of the form and detail thereof may be made therein without departing from the scope of the invention.

I claim:

1. An oil seal means in a rotary piston engine comprising first and second annular oil seal grooves concentrically formed in the side wall of a rotor, and first and second combinations of oil seal rings, annular spring means and annular elastic seal elements, said first and second combinations being mounted in said first and second grooves, respectively, wherein the improvement comprises a flexible annular land means provided between said first and second grooves, said land means being movable in any radial directions of the rotor.

2. The oil seal means of claim 1, wherein said annular elastic seal elements are arranged to directly contact said annular land means.

3. The oil seal means of claim 1, wherein said flexible annular land means comprises a metal ring portion and a flexible bellows portion, said bellows portion being mounted in an annular groove formed in the side wall of the rotor and supporting said metal ring portion.

4. The oil seal means of claim 3, wherein said bellows portions includes an annular bead portion by which it is mounted in said annular groove formed in the side wall of the rotor.

5. The oil seal means of claim 4, wherein said annular bead portion encloses a metal ring core element.

* * * * *